US006533556B1

(12) United States Patent
Cozens et al.

(10) Patent No.: US 6,533,556 B1
(45) Date of Patent: Mar. 18, 2003

(54) PRESSURE BALANCED HYDRAULIC PUMPS

(76) Inventors: Eric Cozens, 3480 Middle Road Unit #5, Burlington, Ontario (CA), L7M 2R8; Chris Van Den Berg, 39 Priscilla Avenue, Toronto, Ontario (CA), M6S 3W1; Richard Muizelaar, 2693 Jerring Mews, Mississauga, Ontario (CA), L5L 2M7

( * ) Notice: Subject to any disclaimer, the term of this patent is extended or adjusted under 35 U.S.C. 154(b) by 0 days.

(21) Appl. No.: 09/639,328

(22) Filed: Aug. 16, 2000

Related U.S. Application Data

(63) Continuation-in-part of application No. 09/336,755, filed on Jun. 21, 1999, now abandoned.

(51) Int. Cl.[7] ..... F04B 49/00
(52) U.S. Cl. ..... 417/310; 417/441; 417/442
(58) Field of Search ..... 417/310, 441, 417/440, 442, 297, 300; 418/15

(56) References Cited

U.S. PATENT DOCUMENTS

| | | | | |
|---|---|---|---|---|
| 2,832,199 A | | 4/1958 | Adams et al. | 417/440 |
| 3,067,689 A | | 12/1962 | Hause | 417/440 |
| 3,195,372 A | | 7/1965 | Clark et al. | 74/734 |
| 3,589,841 A | | 6/1971 | De Lisse | 418/46 |
| 4,008,002 A | | 2/1977 | Niemiec et al. | 417/204 |
| 4,022,551 A | | 5/1977 | Hirosawa | 417/440 |
| 4,183,723 A | | 1/1980 | Hansen | 417/440 |
| 4,299,542 A | | 11/1981 | Potter et al. | 417/214 |
| 4,496,288 A | | 1/1985 | Nakamura et al. | 417/413 |
| 4,597,718 A | | 7/1986 | Nakano | 417/300 |
| 4,943,216 A | * | 7/1990 | Iio | 418/15 |
| 5,217,357 A | | 6/1993 | Welch | 418/46 |
| 5,720,603 A | | 2/1998 | Miller et al. | 418/180 |
| 5,722,815 A | | 3/1998 | Cozens | 417/310 |
| 6,296,456 B1 | * | 10/2001 | Thornelow et al. | 417/310 |

* cited by examiner

*Primary Examiner*—Cheryl J. Tyler
(74) *Attorney, Agent, or Firm*—John R. S. Orange; Orange & Chari

(57) ABSTRACT

A hydraulic pump has a pair of inlets each with a pair of outlets. The inlets and outlets are arranged to balance the forces on the motor. The flow from the outlets of each pair may be combined to maximize flow or separated to reduce power consumption by recirculating the flow from the outlet to the inlet.

10 Claims, 6 Drawing Sheets

PRESSURE BALANCED HYDRAULIC PUMPS

Continuation-in-Part of U.S. patent application Ser. No. 09/336,755 filed Jun. 21, 1999 now abandoned.

The present invention relates to hydraulic pumps.

BACKGROUND OF THE INVENTION

It is well known to utilize hydraulic pumps to provide a source of pressurized fluid in a large number of environments. Several different types of pumps are available and chosen to meet the particular requirements of the intended application.

A particularly demanding application is in an automotive transmission where a pump is used to supply pressurized fluid to the transmission over a wide range of operating conditions. Typically the pump is driven by the transmission and its rotational speed will therefore vary with the engine speed. At the same time the flow requirements may fluctuate significantly over the normal operating cycle demanding high flow rates at low engine speed and vice-versa.

Because the pumps operate over the wide speed range normally encountered in an engine, the flow rate of the pump is typically much greater than is required for operation of the transmission and its power consumption is increased. Typical operating pressures are in the order of 250 psi and therefore the power consumed by the pump is significant but manageable. On the other hand, newer transmission arrangements are increasing the pressure with which the systems will operate and therefore the energy loss becomes significant.

Various attempts have been made to control the energy loss by utilizing different hydraulic valving but these introduce complexity and cost into the transmission system.

The higher pressures currently being contemplated also introduce additional mechanical loading into the pump system which in turn must be compensated for in the overall design. As a result the cost, complexity and weight of the transmission may be increased. Besides the variability in the operating conditions, the automotive transmission application is particularly arduous due to cost sensitivity of automotive components. The components must not only be very reliable but must also be provided at minimum costs. As a result, it is common practice to integrate the components with other transmission components wherever possible to maintain the cost and weight of the components at a minimum.

It is therefore an object of the present invention to provide a hydraulic pump and a hydraulic circuit incorporating such as pump in which the above disadvantages are obviated or mitigated.

SUMMARY OF THE INVENTION

In general terms, the present invention provides a hydraulic pump having a housing and a pumping element rotatable in the housing. A pair of pumping chambers are defined between the housing and the pumping element with each chamber having an inlet to receive fluid from a source. A pair of outlets are provided for each of the inlets and the outlets of one pair are arranged diametrically opposed to the corresponding outlets of the other pair. In this manner the hydraulic forces acting upon the pumping element are balanced.

By providing a pair of outlets, for each inlet the flow from one of the outlets may be diverted to the inlet above a certain flow rate leaving the other outlet to provide the required flow rate at operating pressure. By diverting one of each pair of outlets to their respective inlets, the balance on the pumping element is maintained.

In a further aspect of the invention there is provided a hydraulic system including a pump having an housing and a pumping element rotatable within the housing. A pair of chambers are defined within the housing each having an inlet to transfer fluid from a hydraulic source to the chamber. A pair of outlets are associated with each of the inlets with the outlets of one pair being diametrically opposed to the corresponding outlets of the other pair. A valve is connected to a corresponding outlet of each pair and is operable to direct fluid from the one outlet to its respective inlet.

BRIEF DESCRIPTION OF THE FIGURES

An embodiment of the invention will now be described by way of example only with reference to the accompanying drawings in which.

DETAILED DESCRIPTION OF THE PREFERRED EMBODIMENTS

Figure 1:
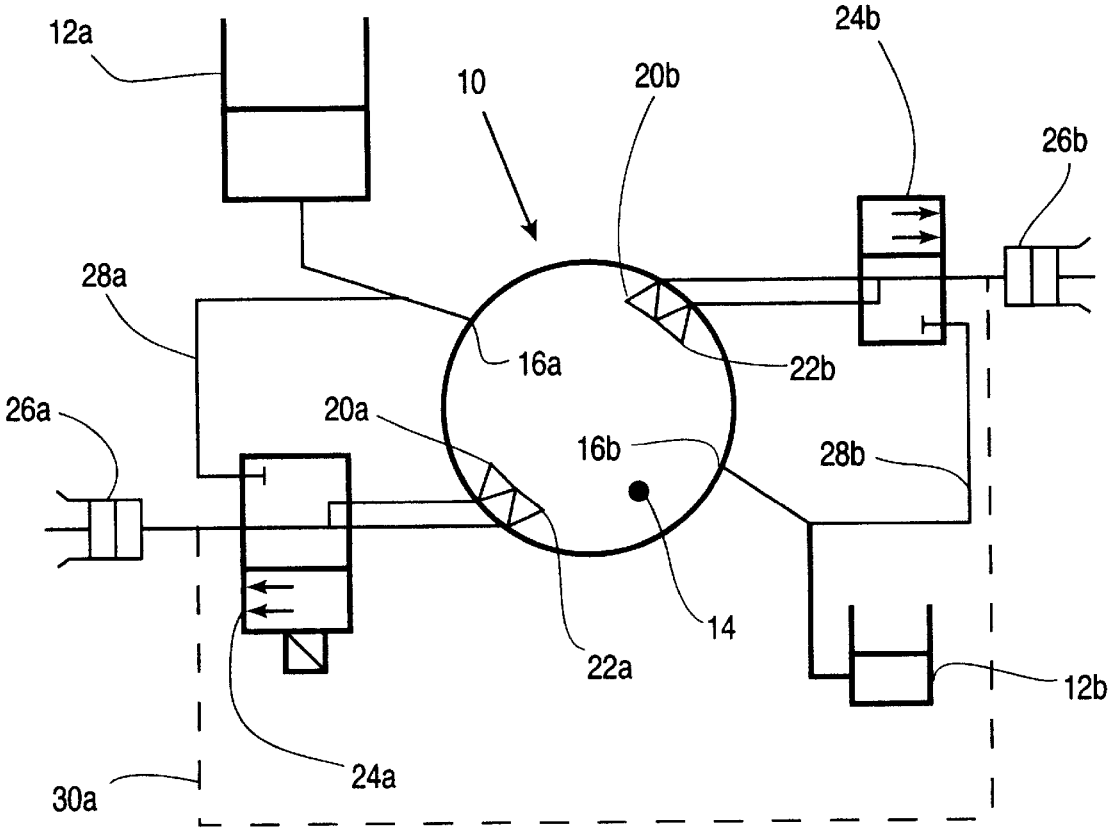
FIG. 1 is a schematic representation of a hydraulic system.

Referring therefore to FIG. 1 a hydraulic system generally indicated 10 includes a source of hydraulic fluid 12*a, b* that supplies fluid to a pump 14. The pump 14 has a pair of inlets 16*a*, 16*b* each associated with a pair of outlets 20*a*, b and 22*a, b* respectively. The pump 14 is driven by a prime mover typically an internal combustion engine (not shown).

Each of the respective pair of outlets 20,22 is connected to a valve 24*a, b* respectively. The valve in the illustrated embodiment is a two position valve which in a first position combines the flow from the respective ports 20, 22 to deliver the combined flow to a hydraulic motor 26*a, b*. A return line 28a, 28*b* is provided from the valve 24*a*, 24*b* to respective inlets 16*a*, 16*b*.

In a second position of the valve 24*a*, b the flow from the outlets 20*a*, 22*a* is split so that one is directed through the return line 28*a* to the inlet 16*a, b* and the other supplied to the respective hydraulic motor 26*a*, 26*b*. Alternatively, as shown in the chain dot line 30*a* the outlets may be combined to supply a common consumer or set of consumers.

The detail of the hydraulic circuit is exemplary in that many variants of that circuit are contemplated.

Figure 2:
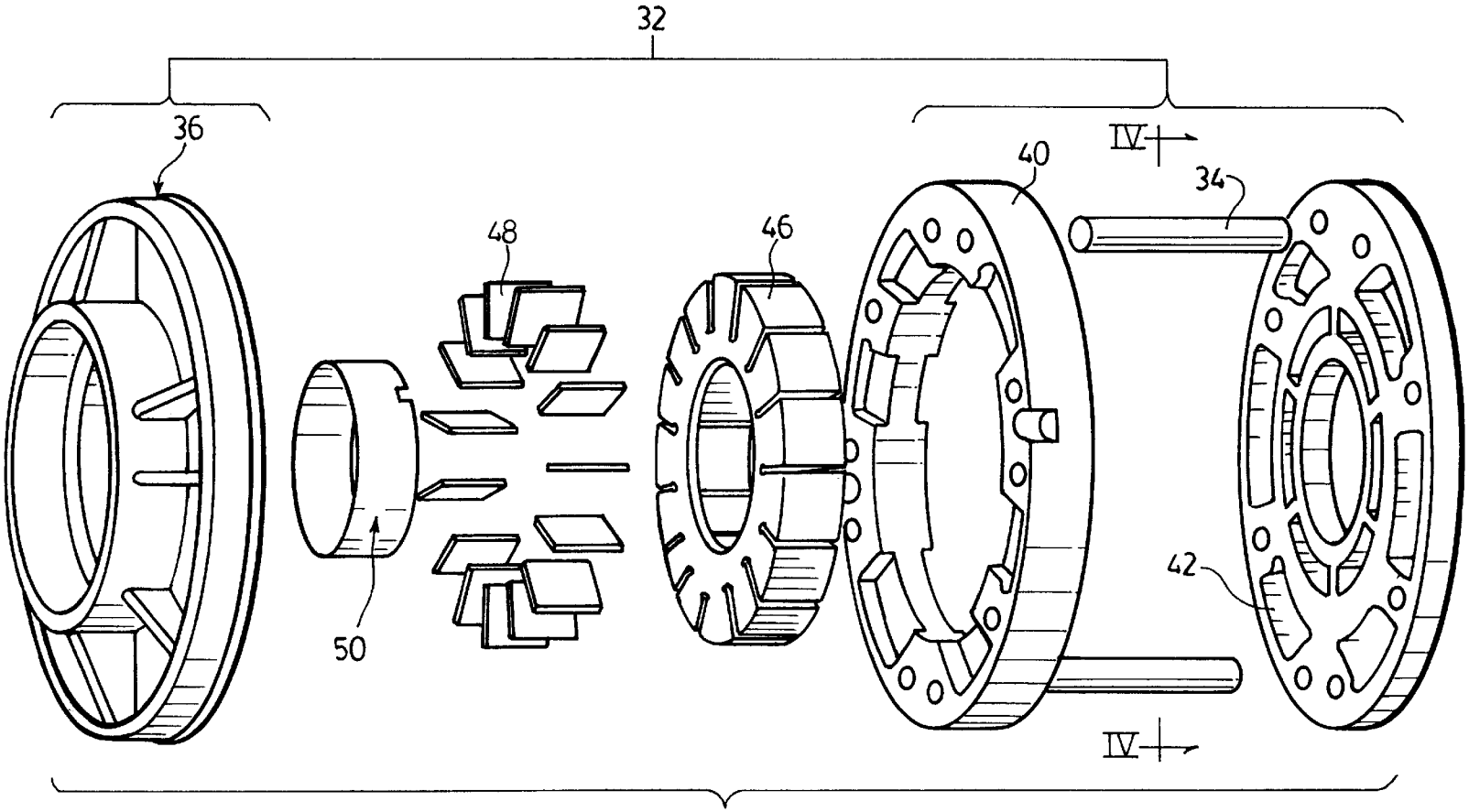
FIG. 2 is an exploded perspective view of a pump.
Figure 3:
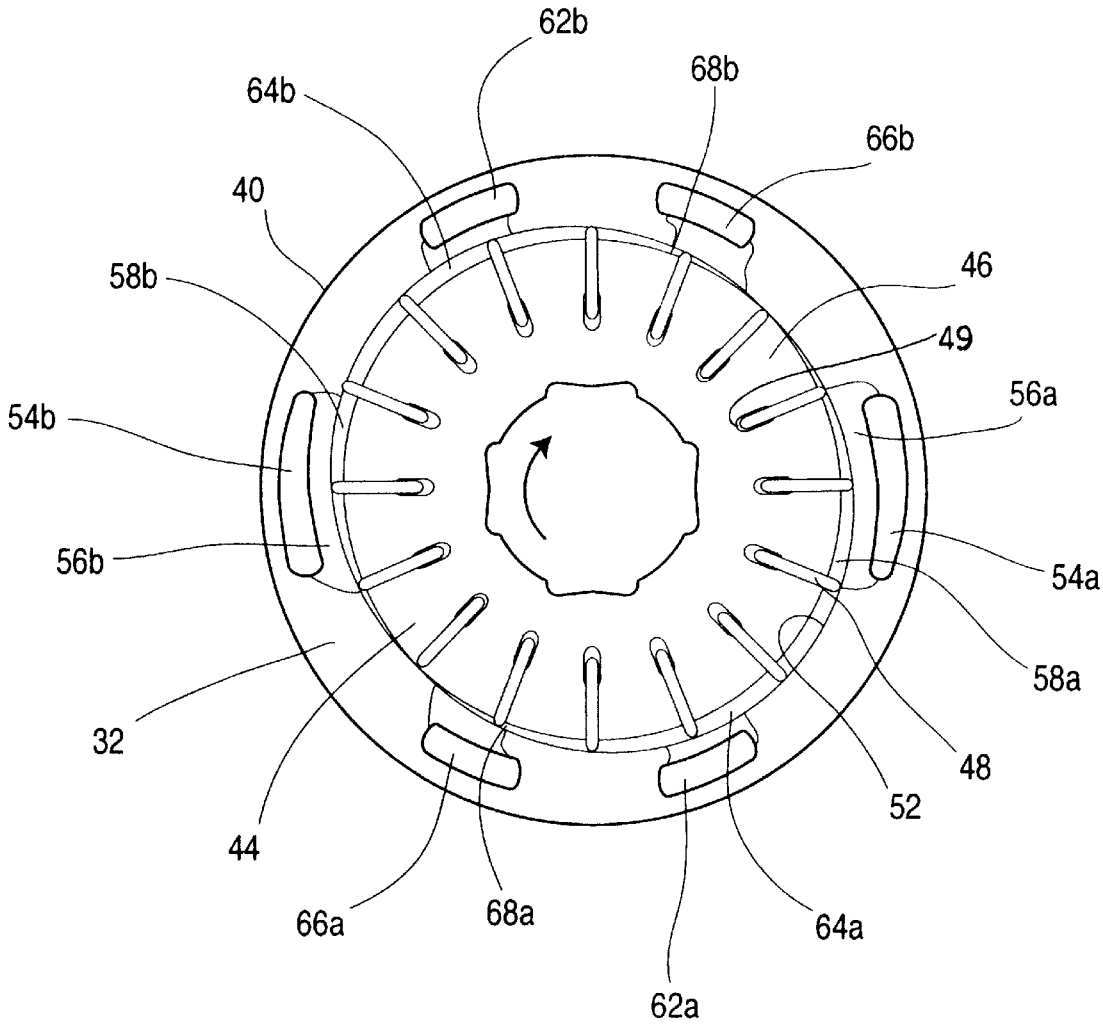
FIG. 3 is a sectional view of the pump shown in the system of FIG. 1.

Referring therefore to FIGS. 2 and 3, the pump 14 includes a housing 32. As shown in FIG. 2, the housing 32 includes a pair of spaced end plates 34, 36 located on opposite sides of a central ring 40. The end plate 34 includes ports generally indicated at 42 that communicate with respective ones of the inlets 16 and the outlets 20, 22 provided in the ring 40.

As shown in FIG. 3, a pumping element 44 is rotatably mounted within the housing 32. Pumping element 44 includes a rotor 46 that carries a plurality of sliding vanes 48, each slidably mounted in a respective slot 49. The construction of the vanes and their mounting in the rotor 46 is well known in the art and will not be described further.

The rotor 46, in a typical automotive application, is mounted upon a drive shaft and the housing 32 secured to a wall of an enclosing structure such as transmission housing. A bushing 50 (FIG. 2) supports the forward end of the drive shaft in the front cover but again the mounting details of the pumping element within the housing 32 may adopt one of a number of well known variants.

Figure 5A:
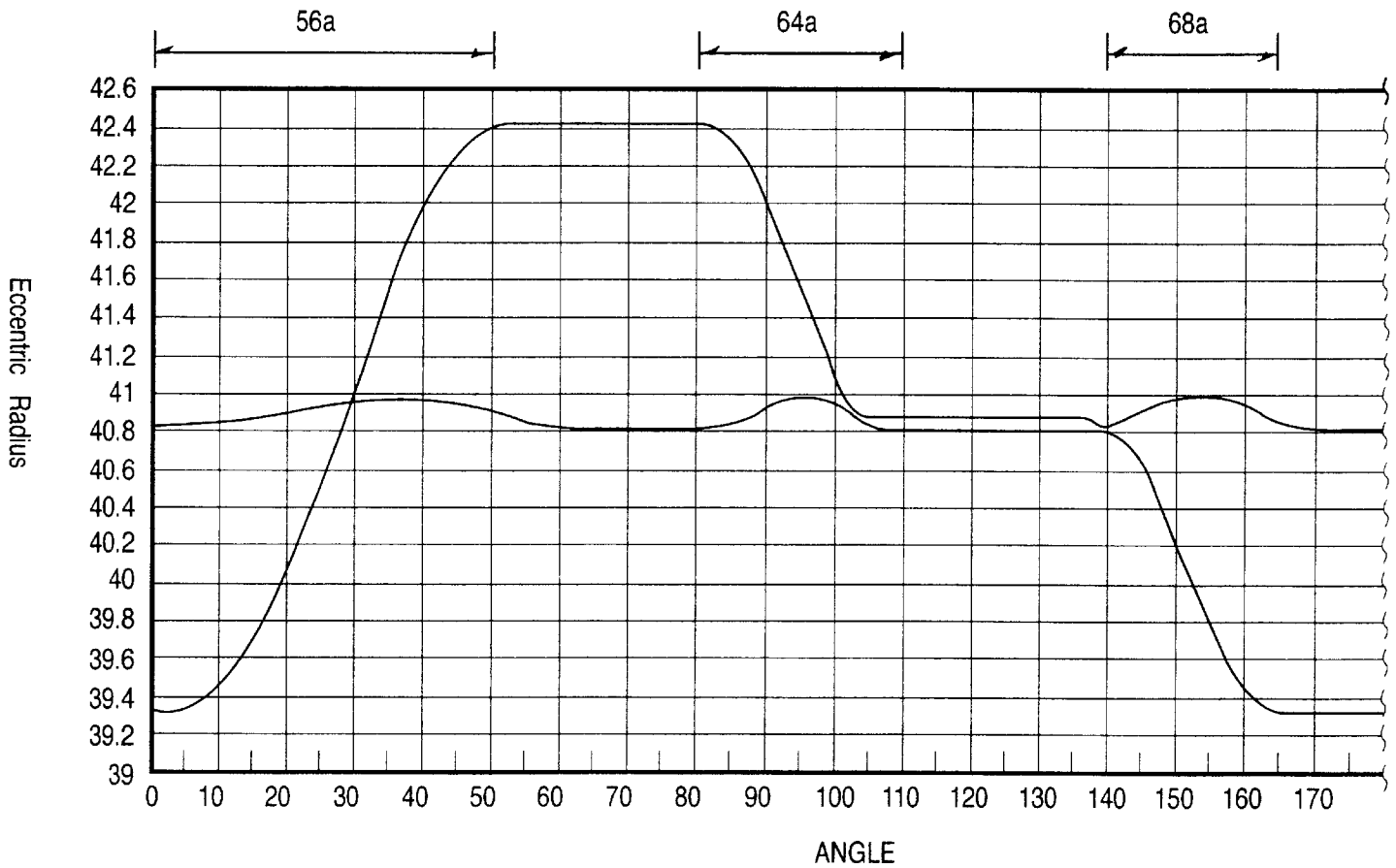
FIG. 5A is a timing diagram showing the spacing of the ports of the pumps shown in FIG. 2 over the first 180° of rotation.
Figure 5B:
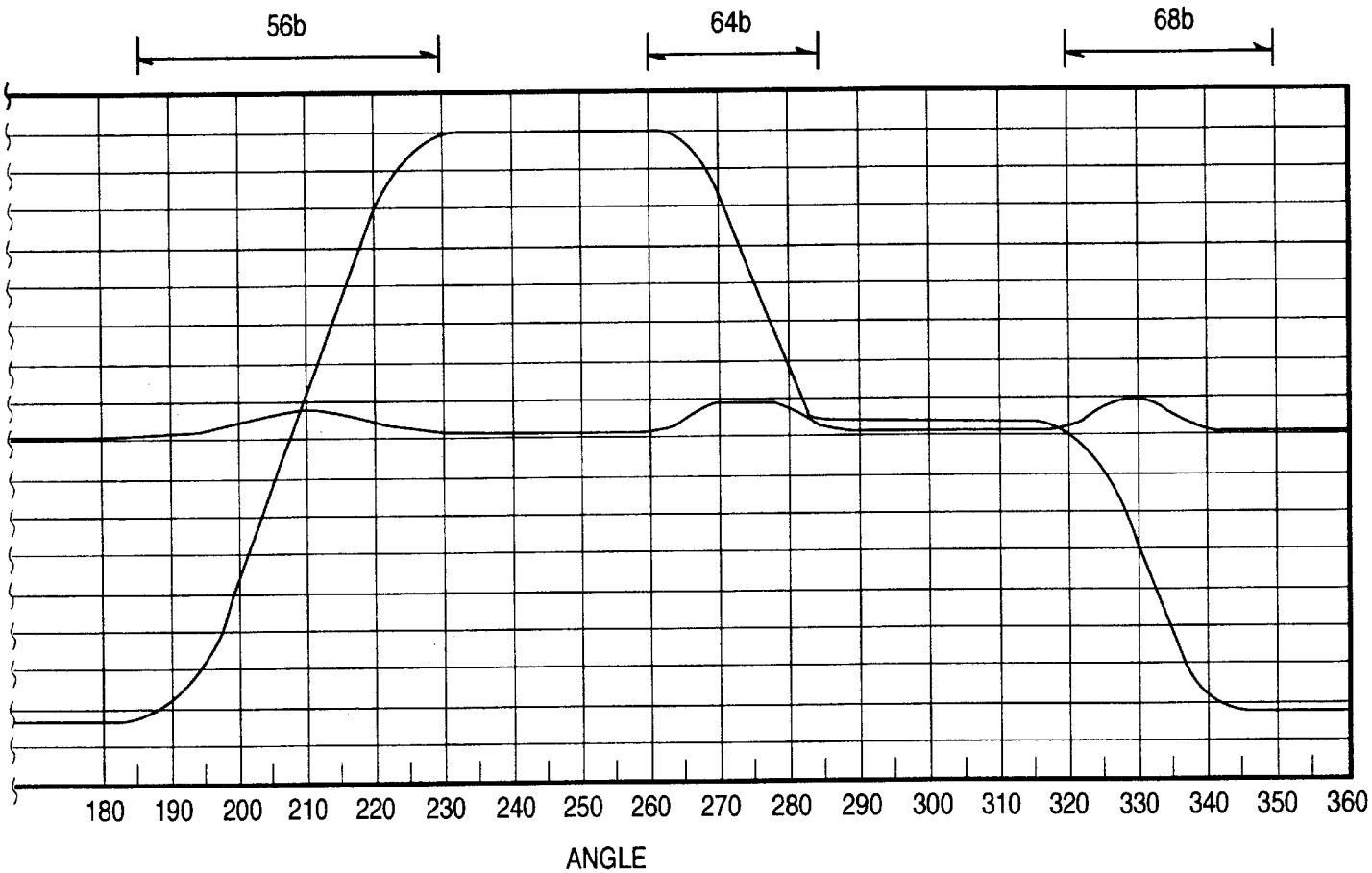
FIG. 5B is a timing diagram showing the spacing of the ports of the pumps shown in FIG. 2 over a second 180° of rotation.

The ring 40 has a radially inwardly directed surface 52 that is contoured as can be seen in FIGS. 3 and 5 to provide pumping action between the inlets 16*a*, 16*b* and the outlets 20, 22. Each of the inlets 16, is provided by axial ports 54*a*, 54*b* in the ring 40 that communicate with radial recesses 56*a* and 56*b* respectively. The recesses 56*a*, 56*b* intersect the inwardly directed surface 52 to permit fluid flow from the axial ports 54*a* into pumping chambers 58*a*, 58*b* provided between the vanes 48 and inner surface 52. The radial spacing between the rotor 46 and the inwardly directed wall 52 increases from a minimum to a maximum over the circumferencal extent of the recess 58 causing the pumping chambers 58*a*, 58*b* to increase in volume.

Outlets 20*a*, 20*b* are likewise defined by axial passages 62*a*, 62*b* that communicate through radial recesses 64*a*, 64*b* to the pumping chambers 58*a*, 58*b*. The inwardly directed wall 52 maintains a constant radius so as to be concentric with the surface of the rotor between the recess 56*a, b* and the recess 64. However over the extent of the recess 64*a*, the radial spacing decreases to an intermediate position causing a decrease in the volume of the pumping chambers 58. Thereafter the radial spacing remains constant until the outlet 22*a, b*.

The outlets 22*a, b* are likewise formed by axial passages 66*a* and *b* and radial recesses 68*a, b* that communicate with the pumping chambers 58*a, b*. The radial spacing between the wall 52 and the rotor decreases over the circumferential extent of the recesses 68 to return to the minimum radius of the wall 52.

The contour of the inwardly directed wall 52 over the extent of the recesses 56*a, b*, 64, 68 conforms to a segment of a cycloid to obtain a uniform radial acceleration of the vane elements 48. It will also be noted from FIG. 3, that the vane elements 48 are circumferencally spaced around the rotor 46 such that at least one vane is always located between the inlet recess 58 and the first outlet recess 64 and likewise at least one vane between the two outlet recesses 64, 68. In this way interconnection between the inlets and outlets within the pump chambers 58 is avoided.

The recesses 56, 64, 68 are arranged around the rotors so that they are diametrically opposed. Thus the inlet recess 56*a* is diametrically opposed to the inlet recess 56*b* and the outlet recess 64*a* is diametrically opposed to the recess 64*b*. Likewise the recesses 68*a* and *b* are diametrically opposed. It will also be noted from FIG. 1 that the corresponding outlet, i.e. 20 or 22 are similarly connected through the valves 24 so that the load placed on the outlets will be similar.

The spacing of the outlet recesses 64, 68 ensures that the radial loads placed on the rotor 46 by the delivery of hydraulic pressure to respective outlets are balanced and therefore the support structure for the rotor 46 need only accommodate the mechanical loads placed on the pump 14. In this way the number of components and the size of those components may be minimized. Where more than two sets of inlets and outlets are utilized, (e.g. 3) the outlets may be uniformly distributed about the circumference to maintain the net forces on the rotor at a minimum.

Figure 4:
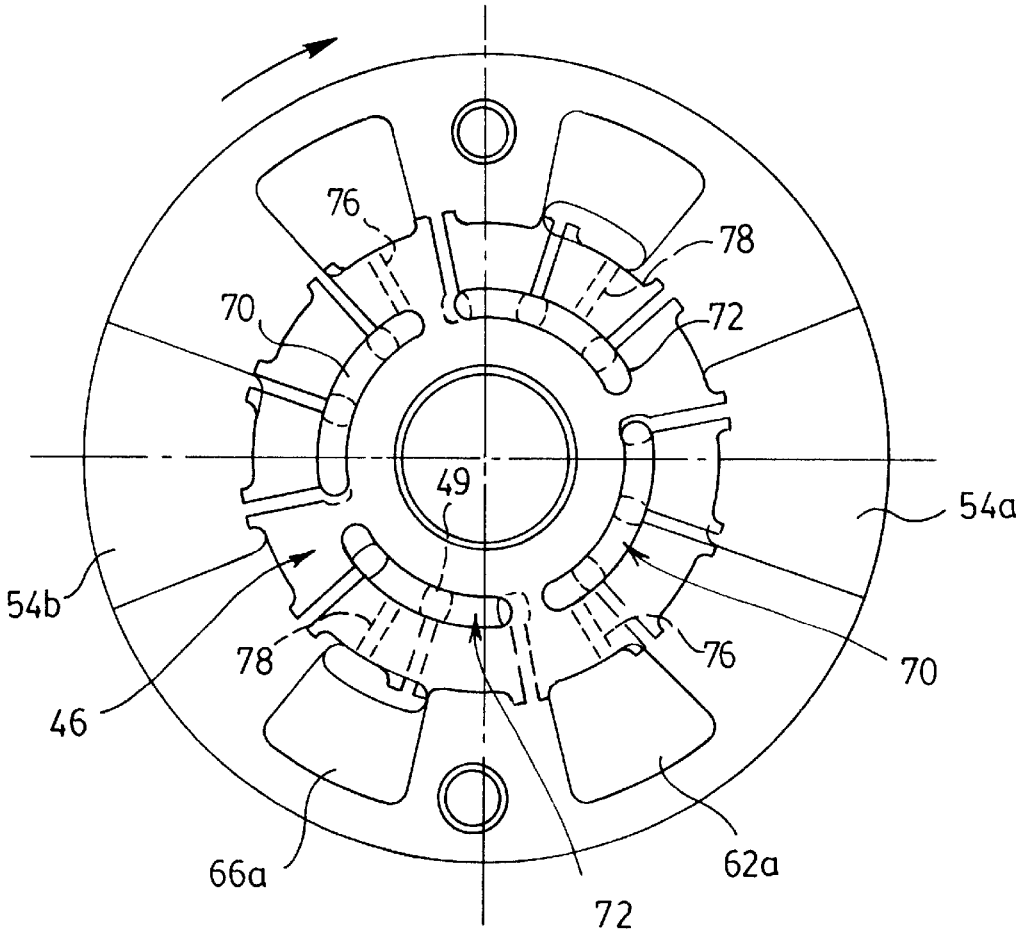
FIG. 4 is a view on the line IV-V of FIG. 2 showing an end face of the end plate.

In order to maintain the vanes 48 in contact with the wall 52, hydraulic fluid is provided to the inner end of the slots 49 shown in ghosted outline in FIG. 4. The fluid is supplied through a pair of kidney ports 70, 72, associated with respective ones of the inlet 54*a*, 54*b* and provided in the end plate 34 as can be seen in FIGS. 2 and 4.

The port 70 adjacent the inlet 54 extends circumferentially across the inlet 54 and outlet 62 and is provided by internal passages 76 with fluid from the outlet 62. Similarly, the port 72 extends circumferentially across the outlet 66 and is connected by internal passage 78 with the outlet 66.

The vanes 48 will thus be biased radially outwardly by the pressure in respective ones of the outlets 62, 66 as the rotor 46 rotates.

In operation therefore, the rotor 46 is rotated by the drive shaft and causes the vanes 48 to pass over the inwardly directed wall 52. As the vanes 48 pass the inlet recess 56*a,b* hydraulic fluid is drawn into the expanding pump chamber 58. The fluid is held between the vanes 48 as it is carried to the outlet recess 64 where the decreasing radius of the inwardly directed wall 52 causes a portion of the fluid to be expelled through the axial port 62*a*. The balance of the fluid is carried to the recess 68*b* where the further reduction in radius causes additional fluid to be expelled. At relatively low speed operation, the valves 24*a* are positioned to combine the outputs from the outlets 20*a*, 22*a* and thereby deliver the required flow rate to the consumers 26*a,b*. As the rotational speed of the rotor 46 increases, the flow to the consumers 26*a,b* can be satisfied by outlet 22*a* alone and therefore the flow from the outlet 20*a* is directed back to the inlet 16*a*. The fluid delivered through the outlet 20*a* is therefore at nominal pressure and the power absorbed by the pump 14 correspondingly reduced. However, because the valves 24*a,b* operate in concert the pump rotor 46 remains balanced.

The provision of the two kidney ports 70, 72 at each inlet is also effective in reducing the fractional drag of the vanes 48 on the surface 52.

With fluid supplied under pressure to each of the outlets 20, 22, both of the kidney ports 70, 72 are fed with pressure. However, when the outlets 20 are operating at nominal pressure, the kidney port 70 is similarly unloaded and the radial force on the vane 48 is reduced.

Adequate sealing at the outlet 22 is maintained as full line pressure is applied to the kidney port 72.

It will be appreciated that the relative flow rates between the outlets 20*a*, 22*a* may be adjusted by varying the change in radius across the respective outlets 64, 68. In this way, the pump performance may to optimized depending upon the particular applications.

As noted above the hydraulic circuit shown in FIG. 1 is merely schematic and illustrative of the general application of the pump 14. The valves 24*a*, 24*b* may be combined into a single unit and the outlets 20*a*, 20*b* and 22*a*, 22*b* may be combined by internal ducting within the housing 32. Likewise the valves 24*a,b* may be controlled by appropriate control circuits sensitive to demands for hydraulic fluid other than the rotational speed of the pump.

Similar arrangements of separate pairs of ports may also be incorporated into other configurations of pump such as slipper roller or radial piston pumps, generally known as cam activated pumps.

What is claimed is:

1. A hydraulic pump comprising a) a housing, b) a pumping element rotatable in said housing including a rotor with a plurality of vanes extending between said rotor and said housing to define pumping chambers between said housing and said pumping element, c) at least a pair of inlets to provide for ingress of fluid through said housing into respective ones of said pumping chambers, d) at least a pair of outlets associated with each of the inlets to provide a plurality of outlet pairs to permit egress of fluid from said pumping chambers, said rotor and housing being arranged such that radial spacing between said rotor and said housing increases as the vanes transverse said inlets, remains constant between said outlets of each outlet pair and decreases as the vanes transverse each of said outlets, said pairs of outlets being uniformly distributed about said housing to balance pumping forces across the pumping element, and e) a first inner port fluidly coupled to a first outlet of a respective one of said pair of outlets and a second inner port fluidly coupled to a second outlet of the respective pair of outlets, each of the inner ports to receive the fluid from the associated outlet such that the fluid pressure of the inner port corresponds to the fluid pressure of the associated outlet, the fluid pressure of each of the inner ports being applied to the inner ends of the vanes associated with the inner ports to bias the vanes radially outward during rotation of said pumtping element.

2. A hydraulic pump according to claim 1 wherein the outlets of each outlet pair are circumferentially spaced from one another on said housing.

3. A hydraulic pump according to claim 2 wherein the relative spacing between said outlets is arranged to provide for a least one of the vanes between said outlets at all times.

4. A hydraulic pump according to claim 1 wherein transition of said housing from one radius to another conforms to a cycloid.

5. A hydraulic system comprising a hydraulic pump having:

a) housing, b) a pumping element rotatable in said housing to define pumping chambers between said housing and said pumping element, c) at least a pair of inlets to provide for ingress of fluid from a source to said pumping chambers, d) at least a pair of outlets associated with each of the inlets to provide a plurality of outlet pairs to permit egress of fluid from said pumping chambers, said pairs of outlets being uniformly distributed about said housing to balance pumping forces across said pumping element, and e) a valve connected to a first outlet of each said pair of outlets, the valve operable in a first condition to direct fluid from the first outlet to a respective one of said inlets and in a second condition to direct fluid to a consumer, wherein the condition of said valve is determined by the rotational speed of said pumping element.

6. A hydraulic system according to claim 5, wherein said valve is operable in a first condition to direct fluid from a second outlet of each outlet pair to a consumer.

7. A hydraulic system according to claim 6, wherein said valve is operable in a second condition to combine fluid flow from the first outlet and the second outlet of each outlet pair.

8. A hydraulic system according to claim 5, wherein said valves operate conjointly to divert fluid from the first outlets to their respective inlets to maintain the balance of the pumping forces across said pumping element.

9. A hydraulic system according to claim 8, wherein the diversion of fluid from the first outlets provides a reduction in the power absorption of the hydraulic pump.

10. A hydraulic system according to claim 9, wherein the diversion of fluid pressure is adapted to reduce the fluid pressure supplied to the inner end of a plurality of vanes extending between a rotor of said pumping element and said housing as the vanes transverse said first outlet, the reduction in fluid pressure providing a corresponding reduction in frictional drag between the outer end of the vanes and an inner contact surface of said housing.

* * * * *